US006305433B1

(12) United States Patent
Peeters

(10) Patent No.: US 6,305,433 B1
(45) Date of Patent: Oct. 23, 2001

(54) AIR FEED BLOCK FOR A MECHANICAL LOOM

(75) Inventor: Jozef Peeters, Ieper (BE)

(73) Assignee: Picanol N.V., Ieper (BE)

( * ) Notice: Subject to any disclaimer, the term of this patent is extended or adjusted under 35 U.S.C. 154(b) by 0 days.

(21) Appl. No.: 09/701,579

(22) PCT Filed: May 28, 1999

(86) PCT No.: PCT/EP99/03687

§ 371 Date: Dec. 11, 2000

§ 102(e) Date: Dec. 11, 2000

(87) PCT Pub. No.: WO99/64651

PCT Pub. Date: Dec. 16, 1999

(30) Foreign Application Priority Data

Jun. 10, 1998 (BE) ..... 9800447

(51) Int. Cl.[7] ..... D03D 47/30

(52) U.S. Cl. ..... 139/435.3

(58) Field of Search ..... 139/435.1, 435.3

(56) References Cited

U.S. PATENT DOCUMENTS 4,850,398 * 7/1989 Van Bogaert ..... 139/435
5,417,250 * 5/1995 Markey ..... 139/435.3
6,109,309 * 8/2000 Dornier et al. ..... 139/435.3

* cited by examiner

*Primary Examiner*—Andy Falik
(74) *Attorney, Agent, or Firm*—Bacon & Thomas, PLLC

(57) ABSTRACT

A weaving machine air supply block (1). The air supply block includes conduits (8 through 13) and switched and/or adjusted valves (14, 15, 16, 17) driven by valve drives (14, 15, 16, 17) configured between an inlet (2, 3) and an outlet (5, 6). The device provides two outlets (5, 6) at one longitudinal side (7) of a substantially right parallelipipedic housing, each outlet being associated with its own valves (14, 15; 16, 17).

10 Claims, 9 Drawing Sheets

AIR FEED BLOCK FOR A MECHANICAL LOOM

BACKGROUND OF THE INVENTION

1. Field of the Invention

The invention relates to a weaving machine air supply block having conduits extending between an inlet and an outlet, and valves switched and/or controlled by valve drives.

2. Description of the Related Art

An air supply block of the initially cited kind is known from the patent document WO 97/29231. This air supply block is mounted between a source of compressed air and a pair of main airjet nozzles which insert a filling into a shed. The known air supply block comprises an inlet connected to the source of compressed air and an outlet connected to the pair of main airjet nozzles. The inlet and outlet are connected by conduits within the air supply block into which are integrated a switched shutoff valve and an adjustable throttling valve. When a weaving machine must process a substantial number of different fillings, a commensurately large number of pairs of main airjets nozzles and furthermore a correspondingly large number of air supply blocks will be required.

SUMMARY OF THE INVENTION

The objective of the present invention is to so design an air supply block of the initially cited kind that feeding comparatively many main air jet nozzles with compressed air is enabled without using a large size compressed-air supply.

This problem is solved by providing two outlets extending along a longitudinal side of a substantially right parallelipipedic housing, each outlet being associated with its own valves.

This invention offers the advantage that using one air supply block, two sets of main air jet nozzles can be supplied with compressed air, as a result of which the required equipment space is relatively small. Such air supply blocks are especially appropriate for airjet weaving machines which process several different fillings.

In a further embodiment of the invention, the said housing is free of inlets, outlets and valve drives on two mutually opposite longitudinal sides. As a result, the air supply blocks can be assembled tightly against each other and compactness is enhanced again.

In yet another embodiment of the invention, the inlet(s), the conduits and the outlets are configured substantially in a common longitudinal plane of the said housing. In this manner the width of the housing of the air supply block can be lessened in the transverse direction and consequently a relatively large number of such units can be received within a relative small space.

Further features and advantages of the invention regarding in particular configuring the air supply blocks within a small space are stated in the further sub-claims.

Embodiments of the invention are shown below in relation to the drawings.

DETAILED DESCRIPTION OF THE PREFERRED EMBODIMENTS

Figure 1:
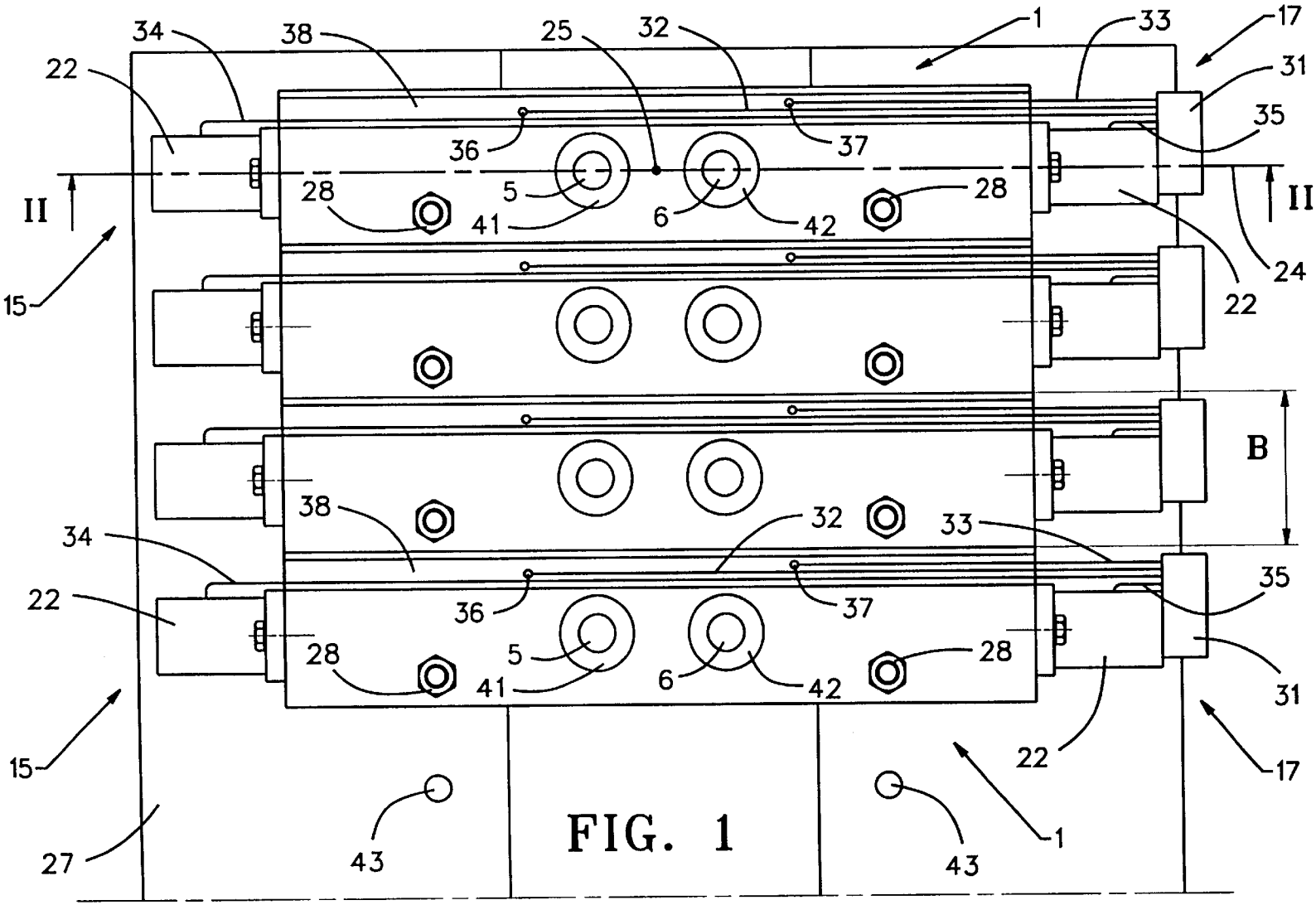
FIG. 1 is a top view of several juxtaposed air supply blocks.
Figure 2:
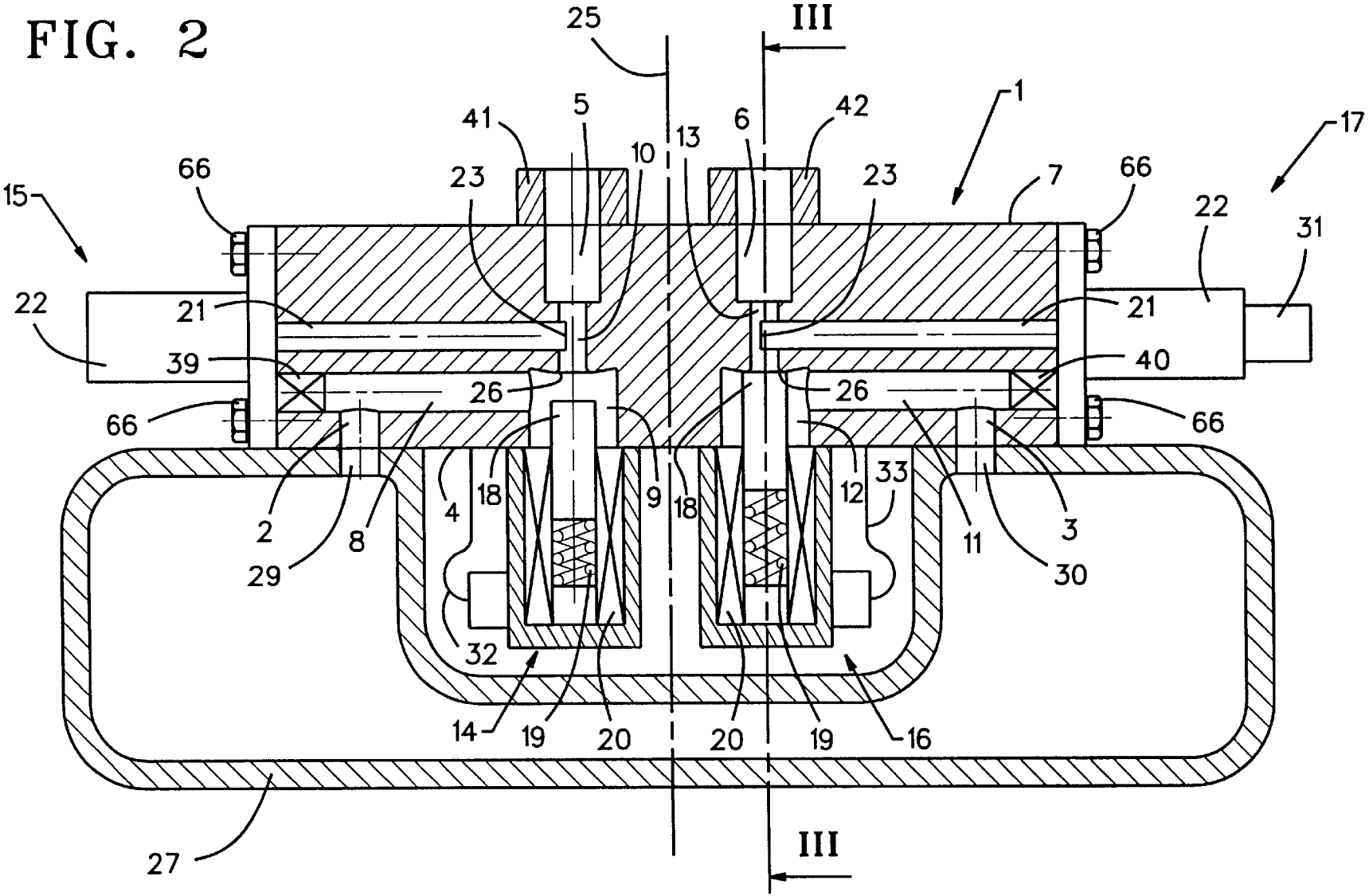
FIG. 2 is a section along line II—II of FIG. 1.
Figure 3:
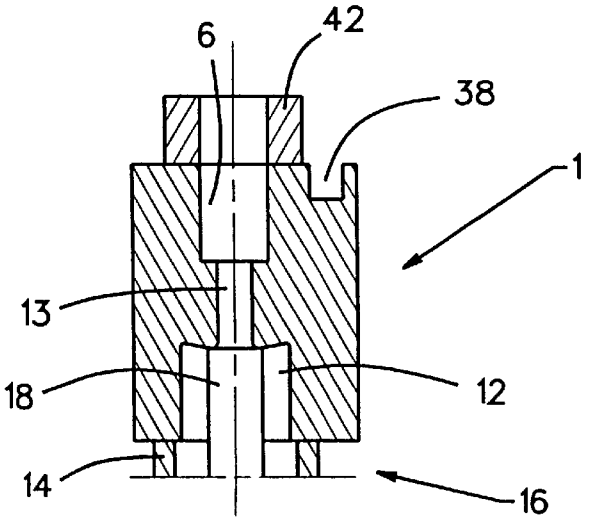
FIG. 3 is a section along line III—III of FIG. 2.

The air supply block 1 shown in FIGS. 1 through 3 feeding an airjet weaving machine comprises a right-parallelipipedic housing fitted with two compressed-air inlets 2 and 3 located along one longitudinal side 4. Two compressed-air outlets 5 and 6 are located at the opposite longitudinal side 7. In the embodiment shown, the particular longitudinal side 4 is the underside and the longitudinal side 7 is the top side of the air supply block 1. The air supply block 1 contains conduits 8, 9 and 10 connecting the inlet 2 with the outlet 5. Correspondingly the conduits 11, 12 and 13 connect the inlet 3 with the outlet 6. A switched shutoff valve 14 and an adjustable throttling valve 15 are located between the inlet 2 and the outlet 5. In a corresponding manner, a switched shutoff valve 16 and an adjustable throttling valve 17 are mounted between the inlet 3 and the outlet 6.

The two inlets 2 and 3, the two outlets 5 and 6, as well as the conduits 8 through 12 are configured substantially in one longitudinal plane 24 (shown in FIG. 1) of the air supply block 1. This longitudinal plane 24 runs perpendicularly to the longitudinal sides 4 and 7. The two outlets 5 and 6 are mounted closer together than the inlets 2 and 3. With respect to transverse center plane 25 running perpendicularly to the longitudinal sides 4, 7 in the longitudinal plane 24, the inlet 2, the outlet 5 and the conduits 8, 9 and 10 are situated in a mirror symmetrical manner relative to the inlet 3, to the outlet 6 and the ducts 11, 12 and 13. Illustratively the conduits 8 through 13 are boreholes in the air supply block 1.

The valve drives 20 of the two switched shutoff valves 14 and 16 are located on the longitudinal side 4 of the block between the inlets 2 and 3. These drives also are located in the above-mentioned longitudinal plane 24 and are mounted in mirror-symmetrical manner to the transverse center plane 25.

One valve seat 26 is associated with each switched shutoff valve 14, 16 and is part of the conduit 9 and 12 respectively. A valve rod 18 is urged by a spring 19 against the valve seat 26 in order to interrupt communication between an inlet 2 or 3 and an outlet 5 or 6. An electromagnet associated with the valve rod 18 acts as the valve drive 20 and lifts said rod off the valve seat 26 in order to open the valve. The valve rods 18 of the shutoff valves 14 and 16 each are situated along a line extending from the associated outlet 5 and 6 and are configured parallel with each other.

The adjustable throttling valves 15 and 17 each are fitted with a spindle 21 which is axially displaceable by a linear motor 22. The end 23 of the spindle 21 enters the associated conduit 10 and 13. By adjusting the position of the spindle 21 in the conduit 10 and 13, the compressed air flowing from the inlet 2 to the outlet 5, or from the inlet 3 to the outlet 6, will be throttled by changing the flow cross-section of the particular conduit 10 or 13 in the manner described in the patent document WO 97/29231. The throttling valves 15 and 17 and in particular the spindles 21 also are located in the above-mentioned longitudinal plane 24 and also are arrayed in mirror-symmetrical manner relative to the transverse center plane 25.

An electrical hookup 31 is mounted on the housing of the linear motor 22 of the throttling valve 17. Electric conductors 32, 33, 34, 35 run from the hookup 31 to the shutoff valves 14, 16 and to the throttling valves 15, 17. A cable (not shown) is connected to the hookup 31 and extends to a weaving machine central control unit. Using only one hookup 31 for both shutoff valves 14, 16 and for both throttling valves 15, 17 is advantageous in assembling the air supply block 1 jointly with the associated parts on a weaving machine and for the various required electrical connections. The electric conductors 32, 33, and 34 are placed in a longitudinal channel 38 in the longitudinal side 7 constituting the top side. The conductors 32 and 33 each run through a borehole 36 and 37 of the air supply block to the valve drives 20 of the switching valves 14, 16.

As shown in FIG. 1, several air supply blocks 1 each are affixed by screws 28 to one compressed-air container 27. The compressed-air container 27 is fitted at its middle with a trough-shaped recess into which the valve drives 20 of the switching valves 14 and 16 extend. To the side of this trough-shaped recess, the compressed-air container 27 is fitted with several outlets 29, 30 adjoining the inlets 2, 3 of an air supply block 1. In the illustrated embodiment, four air supply blocks 1 are mounted on the compressed-air container 27. No air supply block 1 is present in the vicinity of the outlets 29 and 30 which are sealed by stoppers 43.

Seals (not shown) for the shutoff valves 14, 16 and for the throttling valves 15, 17 prevent compressed air from leaking out of the air supply block 1 into this region. Screws 66 affix the valve drives 20 to the air supply block 1. Stoppers 39, 40 are present in the borehole-conduits 8 and 11 at the unused ends. The outlets 5, 6 are fitted with only schematically indicated hookups 41, 42 illustratively connected to the air supply block 1. These hookups 41, 42 connect conduits extending to one or a pair of consecutive main air jet nozzles. In one embodiment of the invention, hookups 41, 42 are screwed at their threaded segments into corresponding threads of the outlets 5, 6.

An air supply block 1 may be made having a small width B (shown in FIG. 1) in the transverse direction by means of the shown embodiment wherein the inlets 2,3, the outlets 5,6, the conduits 8 through 13 and the valves 14 through 17 are mounted substantially in the same longitudinal plane 24, and as a result several such air supply blocks 1 can be configured compactly. Using conventional valves and diameters, an air supply block 1 having a width B about 30 mm can be made.

The air supply blocks 1 comprising two outlets 5, 6 and their associated valves are especially appropriate for airjet weaving machines. Advantageously, the main jet nozzles are used in even numbers in such airjet weaving machines because the same type of filling is fed for instance from two bobbins and insertion into a shed is implemented from two main air jet nozzles or two pairs of main jet nozzles in series in the manner of the disclosure of WO 97/28231. If nevertheless an odd number of outlets is desired, one of the outlets 5 or 6 can easily be stoppered. Obviously as well, the control may be carried out in such a manner that the associated shutoff valve 14 or 16 can remain permanently closed.

The outlets 5 and 6 are spaced by a distance which, for instance, corresponds to the distance between the inlets and the main jet nozzles, for instance in the manner of the Belgian patent application (not prepublished) No. 97 00 645 corresponding to WO 98/54 385 of the applicant. In this way the air supply blocks 1 are especially well suited for main jet nozzles such as are disclosed in said Belgian or International Patent Application.

Figure 4:
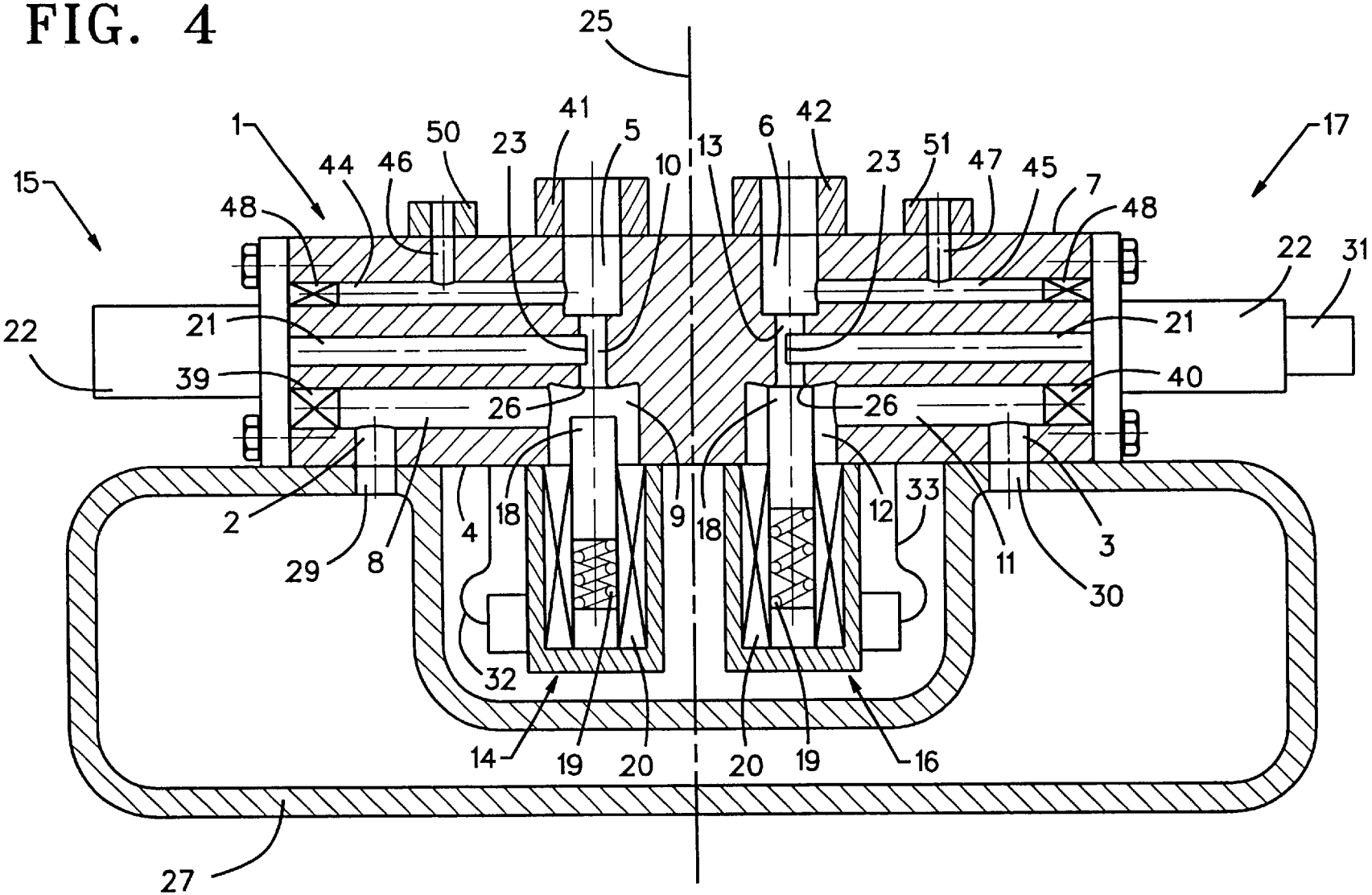
FIG. 4 is a section similar to that of FIG. 2 of another embodiment.

In the embodiment of FIG. 4, the outlets 5, 6 are connected to boreholes 44, 45 which in turn are connected to boreholes 46, 47 running toward the longitudinal side 7. Relative to the transverse center plane 25, the boreholes 44 and 46 are configured in mirror-symmetrical manner to the boreholes 45 and 47. The unused ends of the boreholes 44 and 45 are sealed by stoppers 48, 49. The boreholes 44 through 47 also run substantially in the longitudinal plane 24 of the air supply block 1. The boreholes 46, 47 are fitted with hookups 50, 51 for conduits (not shown) illustratively connected to the air supply block 1. Relatively low-pressure compressed air can be supplied through the boreholes 46 and 47, said air then flowing through the boreholes 44 or 45 to the outlet 5 or 6. Similarly, in the embodiment of FIG. 8, a pressure sensor (not shown) may also be provided at the boreholes 46 or 47 to measure the pressure of the compressed air flowing out of the air supply block 1.

Figure 6:
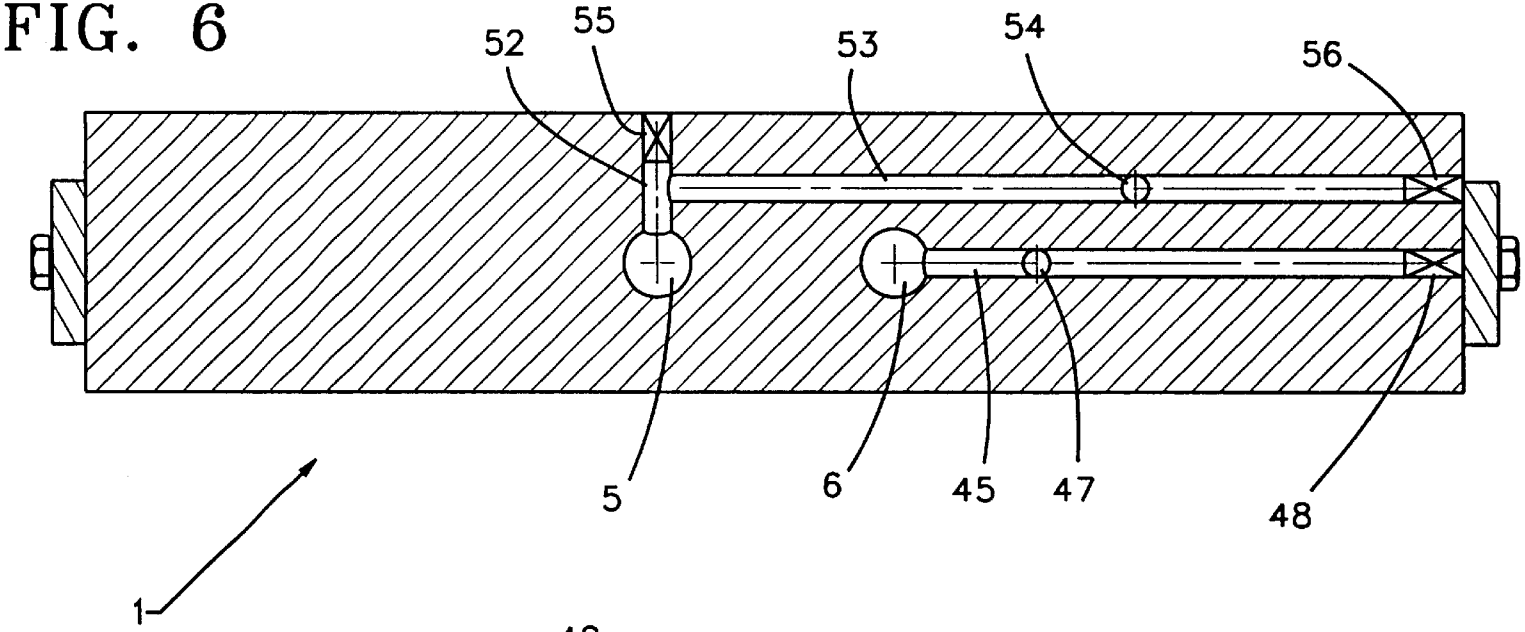
FIG. 6 is a section along line VI—VI of FIG. 5.
Figure 5:
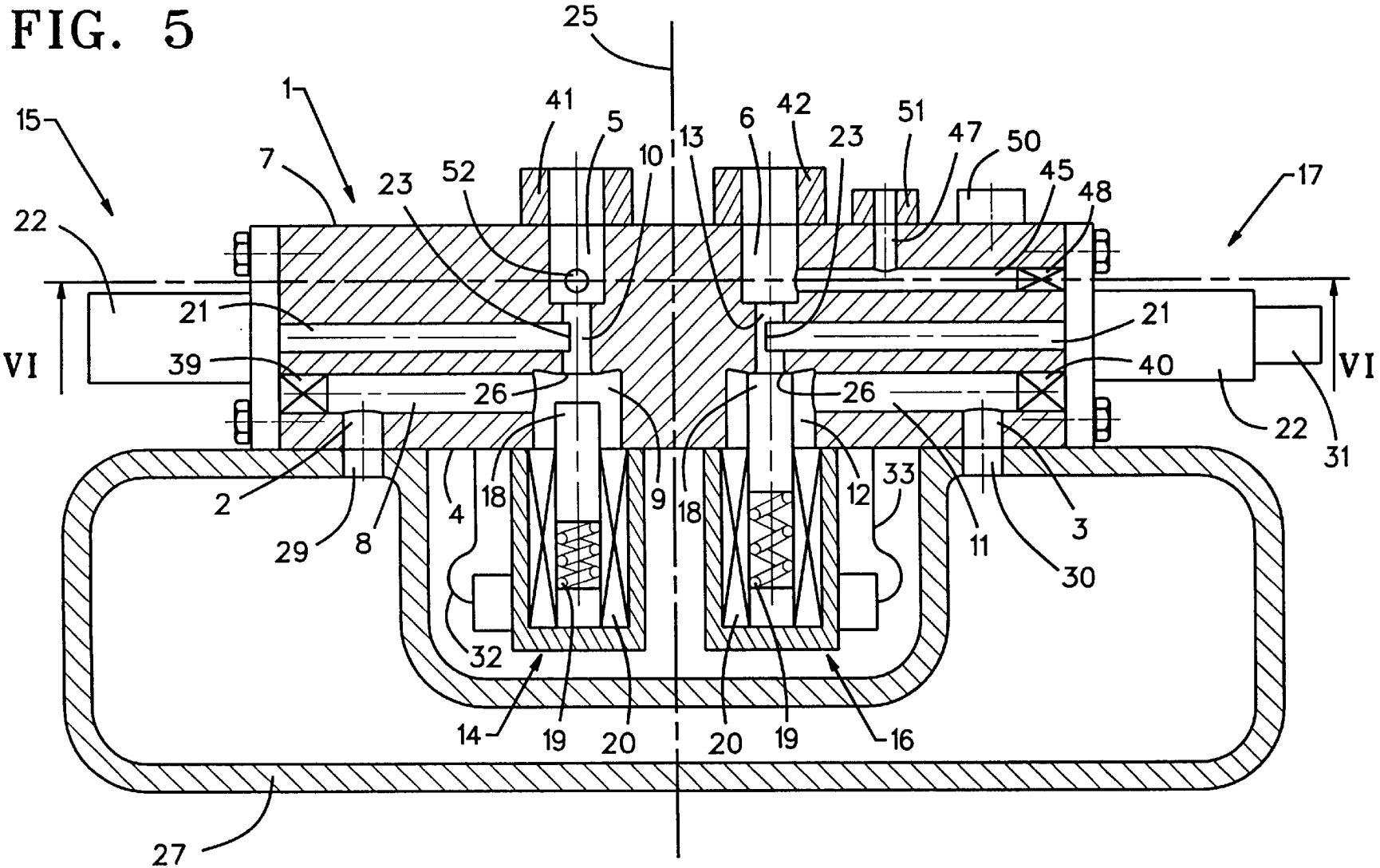
FIG. 5 is a section similar to that of FIG. 2 of still another embodiment.

Another embodiment similar to that of FIG. 4 is shown in FIGS. 5 and 6 wherein boreholes 52, 53 and 54 extend to the outlet 5, the boreholes 52 and 53 being sealed at their unused ends by stoppers 55, 56. The boreholes 52, 53, 54 are somewhat outside the above mentioned longitudinal plane 24. Since the boreholes 52, 53, 54 are relatively small, they hardly affect the total width B of the air supply block 1. This width is substantially determined by the valve drives 14, 16 and/or the seats 26 of the shutoff valves.

Figure 7:
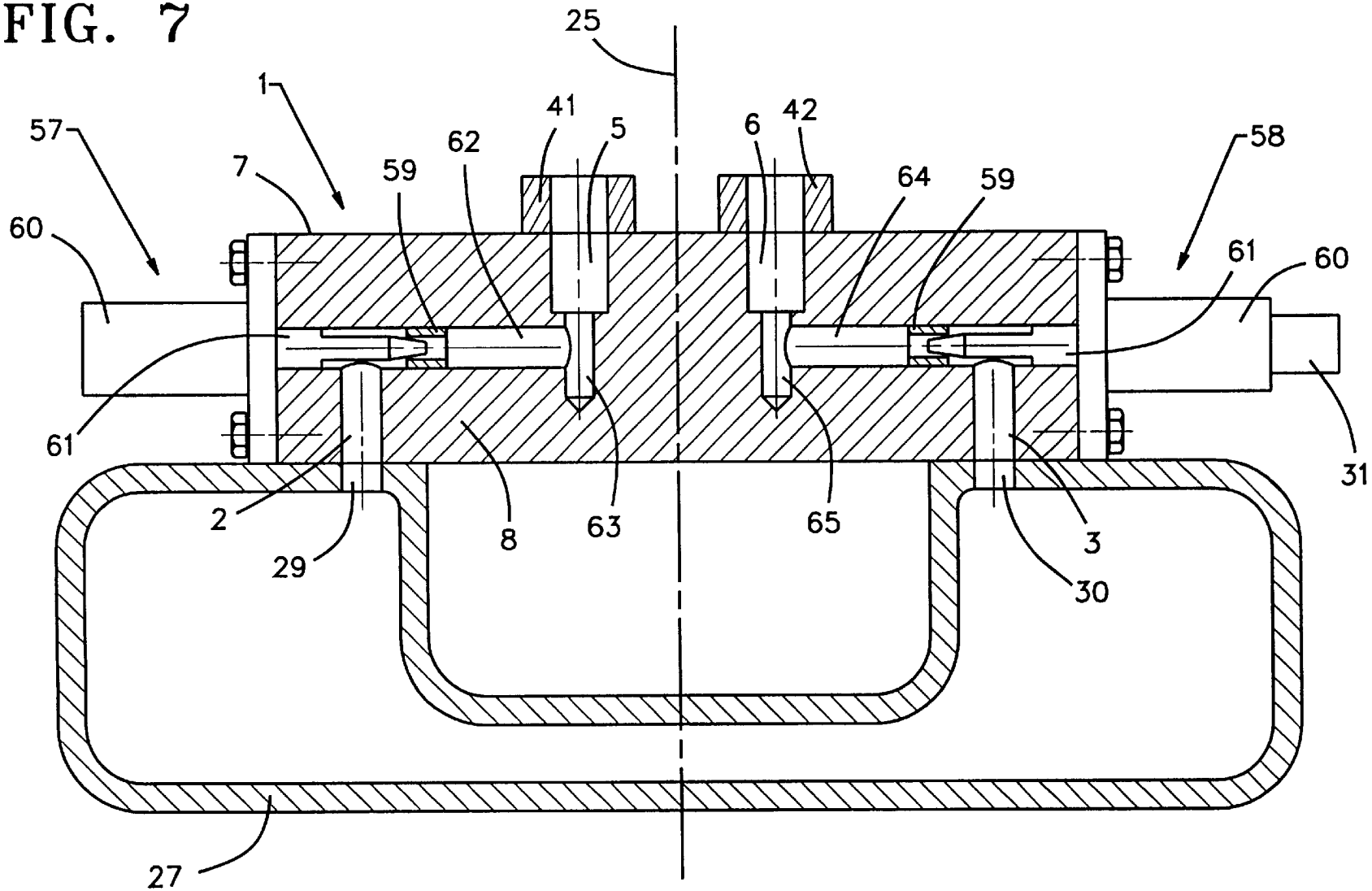
FIG. 7 is a section similar to that of FIG. 2 of another embodiment.

FIG. 7 shows an embodiment wherein the air supply block 1 comprises two inlets 2 and 3 and two outlets 5 and 6 which are respectively communicating through ducts 62, 63 and 64, 65. These ducts all are situated in the same longitudinal plane 24 of the air supply block 1 and are configured in mirror-symmetrical manner relative to the transverse center plane 25. One valve seat 59 for a valve spindle 61 is mounted in each duct 62, 64, the seats 59 and spindles 61 jointly with valve drives 60 in the form of linear motors constituting throttling valves 57, 58. These throttling valves 57, 58 illustratively are the kind described in WO 96/08668.

The air supply block 1 of FIG. 7 is mounted in the manner of the embodiment of FIG. 1 on a compressed-air container 27. The outlets 5 and 6 are each fitted with a hookup 41, 42 connected to conduits (not shown). Illustratively such a conduit can be connected to a hookup 50 or 51 of the air supply block 1 of FIG. 4 in order to convey compressed air, which is at a low pressure throttled by the throttling valve 57 or 58, through said conduits and through the boreholes 44, 46 or 45, 47 to the outlets 5 or 6 of the air supply block 1 of FIG. 4.

In one embodiment, the air supply block 1 of FIG. 7 is mounted on the compressed-air container 27 onto which one or more air supply blocks such as shown in FIG. 4 may also be mounted. In another variation, the air supply block(s) of FIG. 7 are mounted on their own compressed-air container, so as to allow for the predetermining of appropriate air pressures already in the air-feed containers to be used.

Figure 8:
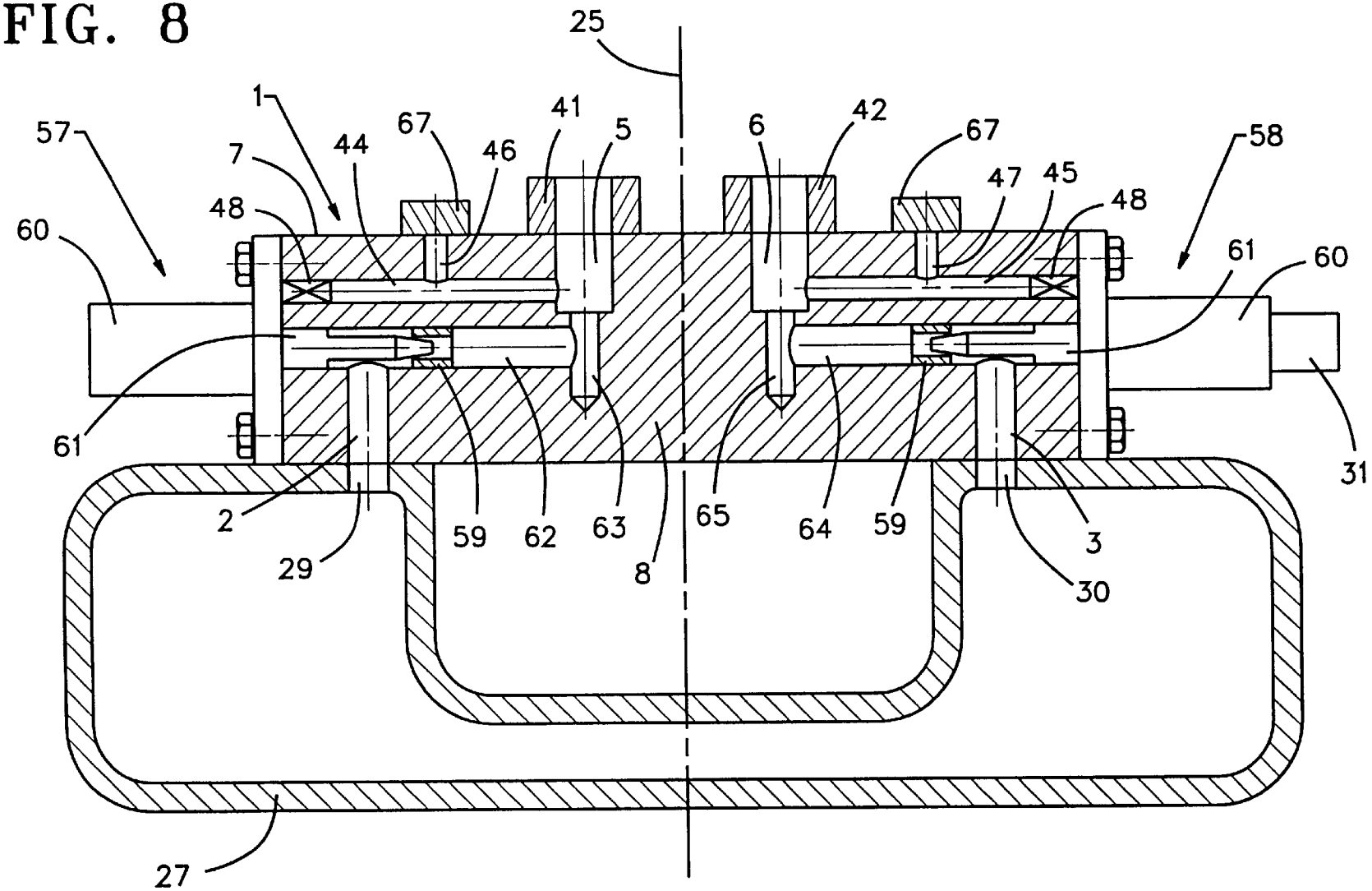
FIG. 8 is a section similar to that of FIG. 7 of a further embodiment.

FIG. 8 shows an embodiment wherein the air supply block 1 includes boreholes 44 through 47 in the manner of the embodiment of FIG. 4. A schematically illustrated pressure pickup 67 is connected to each of the boreholes 46 and 47.

Preferably this pressure pickup is connected by electrical conductors (not shown) connected to the electrical hookup 31 to allow transmitting the measurements to the main control unit of the weaving machine.

Figure 9:
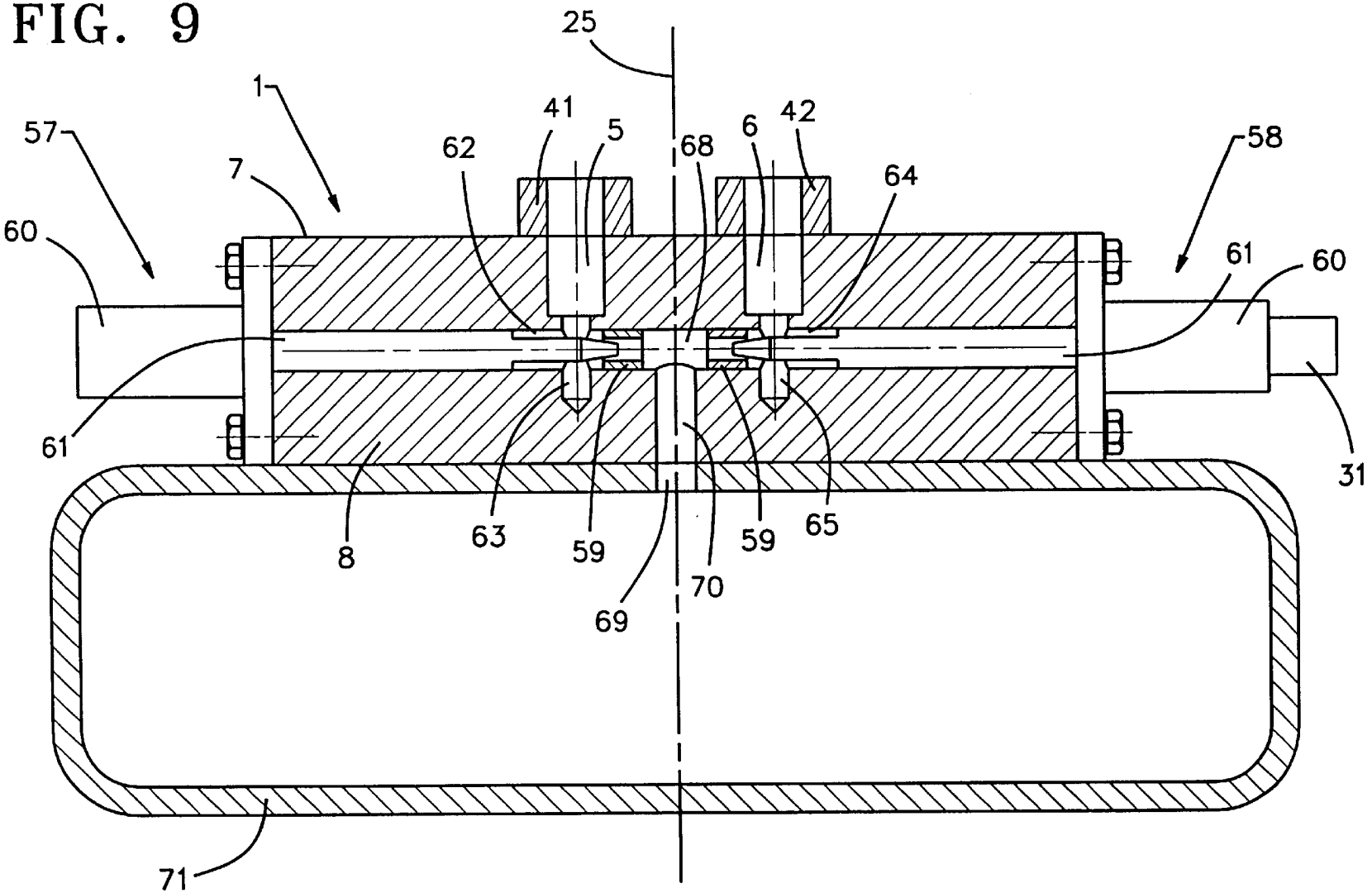
FIG. 9 is a section of still a further embodiment.

FIG. 9 shows an embodiment similar to that of FIG. 7, wherein the components corresponding to those of FIG. 7 have the same reference numerals. The air supply block 1 comprises only one compressed-air inlet 70 situated in the longitudinal plane 24 at the middle plane 25. An outlet 69 of a compressed-air container 71 is situated in that zone. A duct 68 branches off the inlet 70 toward both sides and through a conduit 63 communicates with the outlet 5, and through a conduit 65 with the outlet 6. Valve seats 59 are mounted in the conduit 68 and are associated with the valve spindles 61 of the linear motors 60 of the two throttling valves 57, 58.

Figure 10:
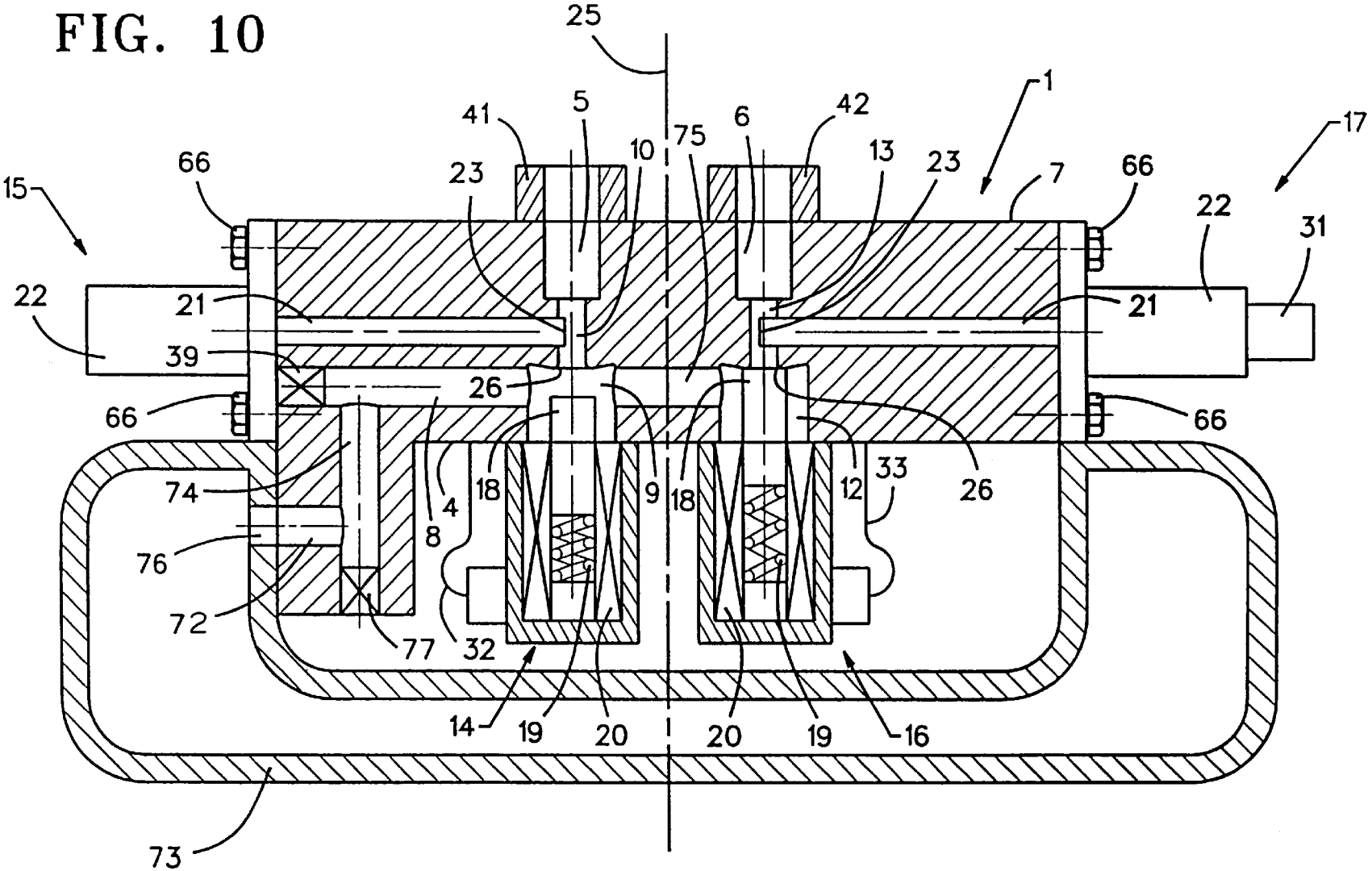
FIG. 10 is a section similar to that of FIG. 2 of still another embodiment.

FIG. 10 shows an embodiment substantially corresponding to that of FIG. 2 and accordingly the same components shall be denoted by the same reference numbers. However the air supply block 1 includes only one compressed-air inlet 72 which is situated in the longitudinal plane 24 of the air supply block 1. This inlet 72 is connected to an outlet 76 which is located in a side wall of the trough-shaped recess in the compressed-air container 73. The inlet 72 communicates through ducts 74, 8, 9 and 10 with the outlet 5 and through ducts 74, 8, 9, 75, 12 and 13 with the outlet 6. The duct 75 connects the through ducts 9 and 12. The duct 74 connects the inlet 72 to the duct 8. The end of the duct 74 is sealed by a stopper 77.

The invention is not restricted to the above shown embodiments. A person skilled in the art recognizes at once that modifications and in particular combinations among the embodiments are feasible without thereby exceeding the scope of the invention defined in the attached claims.

What is claimed is:

1. A weaving machine air supply block comprising conduits (8, 9, 10; 11, 12, 13; 62, 63; 64, 65; 68; 74, 75) located between an inlet (2, 3; 70; 72) and an outlet (5, 6), and valves (14, 15; 16, 17; 57, 58) which are switched and/or adjusted by valve drives, characterized in that two outlets (5, 6) are configured at a longitudinal side (7) of a substantially right parallelipipedic housing and said outlets are associated with their own specific valves (14, 15; 16, 17; 57, 58).

2. The air supply block as claimed in claim 1, characterized in that the housing is free of inlets, outlets and valve drives on two mutually opposite longitudinal sides.

3. The air supply block as claimed in either of claim 1 characterized in that the valve drives (20, 22, 60) are of such dimensions that they are configured to extend only within the periphery of the surface of the housing from which they project.

4. The air supply block as claimed in claim 1, characterized in that the housing is fitted with two sets of outlets (5, 6), of the conduits and of the valves (14, 16; 15, 17).

5. The air supply block as claimed in claim 1, characterized in that the inlet is plural in number, the inlets (2, 3) and the outlets (5, 6) are mounted on mutually opposite longitudinal sides (4, 7) of the air supply block.

6. The air supply block as claimed in one of claim 1, characterized in that the outlets (5, 6), the associated conduits and the associated valves (14, 15; 16, 17) are configured in substantial mirror symmetry relative to a center plane (25) of the housing.

7. The air supply block as claimed in claim 1, characterized in that the inlet is plural in number, the inlets (2, 3; 70, 72), the conduits (8, 9, 10; 11, 12, 13; 62, 63; 64, 65; 68; 74, 75) and the outlets (5, 6) are located in a substantially common longitudinal plane (24) of the housing.

8. The air supply block as claimed in one of claim 1, characterized in that the housing comprises at least one recess (38) for receiving electrical conductors (32 through 34).

9. The air supply block as claimed in claim 1, further characterized by a compressed-air container (27) fitted with prefabricated hookups (29, 30) for mounting several air supply blocks (1).

10. The air supply block as claimed in claim 9, characterized in that the compressed-air container (27) comprises a trough-like recess and prefabricated hookups (29, 30) on each side of said recess.

* * * * *